US005226751A

United States Patent [19]

Doleshal

[11] Patent Number: 5,226,751

[45] Date of Patent: Jul. 13, 1993

[54] CONTROLLING THE ENVIRONMENT AROUND A SUBMERGED PILE OR OTHER STRUCTURES BY ENCAPSULATION, AND TREATING AND REPAIRING THE ENCAPSULATION AREA

[76] Inventor: Donald L. Doleshal, 31460 W. 135th St., Olathe, Kans. 66061

[21] Appl. No.: 830,659

[22] Filed: Feb. 4, 1992

[51] Int. Cl.[5] ..... E02B 17/00

[52] U.S. Cl. ..... 405/211.1; 405/216

[58] Field of Search ..... 405/211, 211.1, 216, 405/227, 257; 52/724, 725, 728, 517

[56] References Cited

U.S. PATENT DOCUMENTS

| | | | |
|---|---|---|---|
| 3,736,759 | 6/1973 | Blöse | 405/216 |
| 4,184,790 | 1/1980 | Bassett | 405/227 X |
| 4,244,156 | 1/1981 | Watts | 405/211 X |
| 4,306,821 | 12/1981 | Moore | 405/216 |
| 4,412,759 | 11/1983 | Britton et al. | 405/227 X |
| 4,439,070 | 3/1984 | Dimmick | 405/216 |
| 4,552,486 | 11/1985 | Knox et al. | 405/227 |
| 4,612,056 | 9/1986 | Gibson | 405/216 X |
| 4,697,957 | 10/1987 | Hellmers | 405/216 |
| 4,708,527 | 11/1987 | Inhofe, Jr. et al. | 405/216 |
| 4,764,054 | 8/1988 | Sutton | 405/216 |
| 4,983,072 | 1/1991 | Bell, Jr. | 405/216 |
| 4,993,876 | 2/1991 | Snow et al. | 405/216 |

FOREIGN PATENT DOCUMENTS

| | | | |
|---|---|---|---|
| 125427 | 5/1989 | Japan | 405/211 |
| 2028405 | 3/1980 | United Kingdom | 405/216 |

*Primary Examiner*—David H. Corbin
*Assistant Examiner*—Arlen L. Olsen
*Attorney, Agent, or Firm*—Kenneth W. Iles

[57] ABSTRACT

A process and apparatus for creating a controlled environment about a portion of a submerged pile to be treated comprises a jacket fitted about the pile and sealed at both the top and bottom ends relative to the pile to provide a sealed encapsulated space. The jacket includes at least two sections having arcuate cross sections that are fastened together to provide a substantially cylindrical jacket. Compressed air is forced downward into the encapsulated space through one or more upper valves and encapsulated water is forced out through one or more lower valves. Further air flow dries the encapsulated space. Desired coatings, for example, rust inhibitors, epoxies, are introduced into the encapsulated space through the lower valve and the displaced air, excess coatings and chemical by-products are vented and recovered for disposal through the upper valve. The temperature inside the encapsulated space is also controlled.

23 Claims, 4 Drawing Sheets

CONTROLLING THE ENVIRONMENT AROUND A SUBMERGED PILE OR OTHER STRUCTURES BY ENCAPSULATION, AND TREATING AND REPAIRING THE ENCAPSULATION AREA

BACKGROUND OF THE INVENTION

1. Field of the Invention

This invention relates to controlling the environment about an underwater pile or other structure. More particularly, the invention relates to a process for controlling the environment about an underwater or submerged pile and applying various preservative techniques to reduce deterioration of the pile due to wave action, tides, corrosion, insects, marine animals and so forth.

2. Description of Related Art Including Information Disclosed under 37 C.F.R. Sections 1.97–1.99

Piers, off-shore oil platforms and the like are customarily anchored and supported by steel piles that are driven deep into the sea floor. These piles are typically steel pipes that may range in diameter from a few inches to a several feet. They may be very long.

In some applications wooden piles are used. Wooden piles are typically treated with a preservative to extend their lives, but they also suffer deterioration from rot, boring animals and the like, which normally extends from the top of the pile to the mud line. Sheet piles are also frequently used, most commonly to prevent erosion of a shore line.

These three forms of piles, that is, steel piles, wooden piles, and sheet piles, as well as other underwater structures will be referred to collectively as "piles" herein. The piles corrode or otherwise deteriorate and attract destructive marine life, such as barnacles. The portion of the pile that is sunk into the sea floor typically does not corrode much because there is very little oxygen available there. Further, as the water becomes deeper, there is less oxygen in it and less corrosion or other deterioration.

The portion of the pile that is subjected to wave action and tides, that is, the portion relatively close to the surface, suffers from significant corrosion or other deterioration, which significantly shortens the life of such structures. This splash zone usually does not exceed forty feet, even in areas such as the North Sea. Accordingly, forty feet is frequently the longest portion of a pile that would be protected. Protecting the splash zone of piles is particularly important because the repeated wetting and drying of the pile accelerates corrosion and other deterioration, especially in salt water.

In the case of wooden piles, boring marine animals and other deterioration typically affects the pile throughout the length from the top of the pile to the mud line and this entire length should be treated. Further, wooden piles should be repaired and strengthened, especially when significant damage has been done to them.

Efforts to address these problems have led to a number of proposed solutions in the related art. Many of these efforts to prevent or reduce that corrosion are largely ineffective over the long term. They include, for example, wrapping the piles with gauze-like material saturated with heavy petroleum or grease, which can wash away, leaving the pile unprotected and polluting the environment. Other coatings are applied underwater after the pile has been installed. Some of these proposed solutions have led to patented inventions. The related art known to the inventor is discussed below.

U.S. Pat. No. 4,993,876, issued to Snow et al., discloses a "Method and Apparatus for Protective Encapsulation of Structural Members" which involves applying a jacket to the desired portion of a pile and injecting a two part reactive polymer mixture into the jacket. A different color can be included in each polymer component to form a third color when the two components mix, allowing visual monitoring of the degree of mixing and the distribution of the mixture when a transparent or translucent jacket is used. The components are mixed outside of the jacket. The jacket is sealed at the bottom and the polymer (such as epoxy) displaces the water from inside the jacket as it is injected. Prior to installation of the jacket, the pile must be cleaned twice by hand and a biological inhibitor solution may be injected into the jacket prior to grouting. No details are disclosed regarding the seal at the bottom of the jacket. Standing water in the installed jacket is not removed except when displaced by the polymer mixture, which includes three principal components in the preferred embodiment and apparently does not expand as it cures.

U.S. Pat. No. 4,983,072, issued to Bell, Jr., discloses a "Method of Protecting Submerged Piling" in which a pile is surrounded by a flexible sheet of plastic that is resistant to ultraviolet radiation. The sheet is porous. It forms a space around the pile. That space is filled with a filler material, such as sand and silt, which, according the patent, keeps marine pests from boring into the pile. Bell, Jr. U.S. Pat. No. '072 does not disclose the manner of attachment of the sheet to the pile.

U.S. Pat. No. 4,764,054, issued to Sutton, discloses a "Piling-Jacket System and Method" in which a split jacket is held in place by a steel band at each end. A zipper is used to close the lengthwise split in the jacket. The steel bands are seated in notches or grooves cut into the pile. These grooves weaken the pile. A rigid access tube is inserted through an open port in the jacket for injecting grout. It appears that concrete is the grout of choice. Standing water within the jacket is not removed prior to filling the space with grout, but is merely displaced by the incoming grout, which must be injected in two stages, with some curing allowed prior to the second injection to prevent leakage at the bottom of the jacket. Waiting for some grout to cure before complete the job increases both the labor and capital costs.

U.S. Pat. No. 4,697,957, issued to Hellmers, discloses a "Marine Pile Protective System" in which a split tube of extruded hexeneethylene copolymer is slipped around a pile and the split edges are snapped together. The seam is sealed with a foam polyurethane strip, as is the bottom of the jacket. The jacket can be drawn tightly against the pile by nylon webbing and is held in its final position by aluminum alloy nails. The jacket provides a water and air tight seal around the pile, excluding oxygen from the pile. There is no filler material within the jacket.

U.S. Pat. No. 4,306,821, issued to Moore, discloses a "Method and Apparatus for Restoring Piling" in which an outer form is attached to a portion of a damaged piling. A filler is placed into the space between the form and the piling. The form is secured to the piling with bands and a space is maintained between the form and the piling by spacers. The filler, preferably epoxy, can be introduced through a filler tube in the lower portion or a second filler tube at the top of the form, the latter of which can be progressively withdrawn as the filler is injected. The method can be used on either wet or dry portions of the piling. No effort is made to dry the piling prior to injection of the filler.

U.S. Pat. No. 3,736,759, issued to Bloese, discloses a "Pile Covering" in which a sheath is secured to the pile and an expandable filler material is expanded in place between the jacket and the pile to form a closed-cell filler. To develop greater adhesion between the foam and the jacket, the jacket may include friction ribs. The method may also include cleaning the pile, attaching the sheath, which is sealed by a collar below the water line, pumping out the standing water and drying the prior to injecting the filler. There is no indication of how these functions are accomplished.

These related art efforts to solve the problems of corrosion and other deterioration, however, suffer from serious shortcomings. These methods are difficult and expensive to use. Moreover, they provide only temporary and incomplete solutions to the problems of corrosion and other deterioration, often due to poor adhesion to a pile by any protective material. Many of the coatings fracture when vessels bump into them during berthing, allowing the water to come into contact with the water again. In this case, the coating may appear to protect the pile when it does not.

In another shortcoming, for example, they leave in place any contaminating materials already on the pile. Further, the jacket is left in place on the pile and it cannot be used again, but it does little to increase protection of the pile. There is no provision in the related art discussed herein for recovering any excess products or waste products, which may be toxic, that may be generated during treatment of a pile, increasing the threat to our marine environments.

The sheaths or jackets of these related art references are open at the top, restricting their use to structures that extend above the water line and requiring applications in which the top of the sheath is above the water line. Moreover, the related art discussed herein does not disclose or suggest any apparatus or process for creating a controlled, sealed environment about a portion of a submerged pile. Further, there is no disclosure of a system that can tolerate high pressures that can be necessary to force a coating into cracks and other surface defects of a pile.

Accordingly, there is a need for an apparatus and a process for creating a controlled environment about a portion of a pile to be treated and protected. Once a controlled environment is achieved, the space in that environment can be dried, then treated with any desired treatment to prevent further deterioration of the pile, to provide protection from future environmental hazards, to provide protection from impacts, and even to rebuild the structural integrity of the piles. In addition, important contributions to the environment can be made by recovering any excess chemical products or waste products generated during treatment of the piles. Fundamentally, a need exists for a means for creating a controlled, sealed environment about an underwater structure, such as a pile, and treating and repairing that structure, in order to extend the life of the structure at a substantial savings over replacing it.

SUMMARY OF THE INVENTION

Accordingly, it is a primary object of the present invention to provide a means for creating a controlled environment about a portion of a submerged pile to be treated. After a controlled environment is created in an encapsulated space along a desired portion of a pile, any treatment method can be used more effectively because superior adhesion of coatings is achieved and temperature suitable for proper curing of coatings can be maintained.

It is another object of the present invention to provide a means for creating a controlled encapsulated space about a portion of a pile to be treated that is either partially or wholly underwater.

It is another object of the present invention to provide a means for encapsulating and treating a joint between two or more underwater members and adjoining portions of the members.

It is another object of the present invention to provide a means for creating a controlled environment in an encapsulated space about a portion of a pile to be treated that can be used in any spatial orientation or with any shape of underwater structure.

The invention comprises creating a controlled environment about the pile along whatever portion needs to be protected and then manipulating that environment to protect the pile through any of a variety of treatment and coating techniques.

The desired portion of the pile is enclosed within a tube or jacket having a seal, such as a gasket, or cap at each end. The jacket may be made from plastic or a resilient material such as rubber, which will withstand routine bumping by berthing vessels without breaking. Such jackets are left in place on the pile when the job is finished.

Alternatively, in a preferred embodiment, a metal jacket is provided, which is removed from the pile at the conclusion of a job and is reused on subsequent jobs. The jacket and the gaskets or end caps are sealed along all seams, i.e., relative to each other and to the pile.

When the jacket and gaskets or end caps have been installed, a portion of the pile and some surrounding space has been encapsulated. The environment within this encapsulated space can be controlled and manipulated as desired to provide a desired level of treatment, protection and repair of the pile within the encapsulated space.

One or more upper valves are oriented to allow fluids to flow into the jacket and one or more lower valves are provided in the jacket or end cap at a location remote from the upper valves, typically toward or at the bottom of the jacket. The upper valves initially carry compressed air into the encapsulated space to force out the water and to dry the encapsulated space. The water is forced out through the lower valves.

After drying, the pile is ready for coating. The direction of fluid flow through both the upper and lower valves can be reversed. In applying the desired coating, it is typically admitted into the encapsulated space through the lower valves and the air that is thus displaced and any excess coating material and vapors are vented through the now reversed upper valve. Typical treatment regimens include, for example, the following.

Fresh water can be repeated introduced into the jacket to flush the jacket and pile and thereby purge any contaminants such as mineral salts from the encapsulated space. Alternatively, commercial solvents can be introduced to flush out contaminants and to prepare the surface of the pile to accept a coating or finish. For example, the surface may be etched, rust removed, and so forth. Any such solvents would be recovered via the outlet valve and a remotely located recovery tank to protect the environment.

If desired, a rust inhibitor can be also be applied through the jacket, followed by further compressed air to allow the rust inhibitor to dry or cure.

Then the jacket may be filled with a firm resilient, non-corroding compound that prevents water from contacting the pile. This can be done whether or not the jacket is left in place when the job is finished. For example, the jacket can be filled with an expanding closed-cell foam formed from liquid chemicals, epoxy resins or the like.

When the jacket is to be left in place permanently, the valves are removed and the openings are sealed without allowing water to infiltrate the jacket. In a preferred embodiment, however, the jacket is removed from the pile after the coating has cured, allowing the jacket, end seals, and valves to be reused.

Once the desired portion of the pile is thus encapsulated by a cured coating, very little if any oxygen and no corrosive salts come into contact with the pile, which therefore cannot corrode. This technique protects piles against corrosion better than existing techniques, at lower cost, at reduced risk to the divers, and requires far less labor than existing techniques. It also protects the environment by recovering toxic waste.

This same technique can also be applied to wooden piles, I-beams, concrete piles, sheet piles, and other structures. These techniques can be used to create a controlled environment about piles in an encapsulated space that is completely underwater and may also be used to encapsulate and treat joints between two or more submerged members, regardless of their orientation in space or of the angles at which multiple members meet.

Other objects and advantages of the present invention will become apparent from the following description taken in connection with the accompanying drawings, wherein is set forth by way of illustration and example, the preferred embodiments of the present invention and the best mode currently known to the inventor for carrying out his invention.

DETAILED DESCRIPTION OF THE PREFERRED EMBODIMENTS

As required by the Patent Statutes and case law, the preferred embodiments of the present invention and the best mode currently known to the inventor for carrying out the invention are disclosed in detail herein. The embodiments disclosed herein, however, merely illustrate the invention, which may be embodied in various forms. Therefore, specific structural and functional details disclosed herein are not to be interpreted as limiting, but merely to provide the proper basis for the claims and as a representative basis for teaching one skilled in the art to employ the apparatus and processes disclosed herein in any appropriately specific and detailed process or structure.

Figure 1:
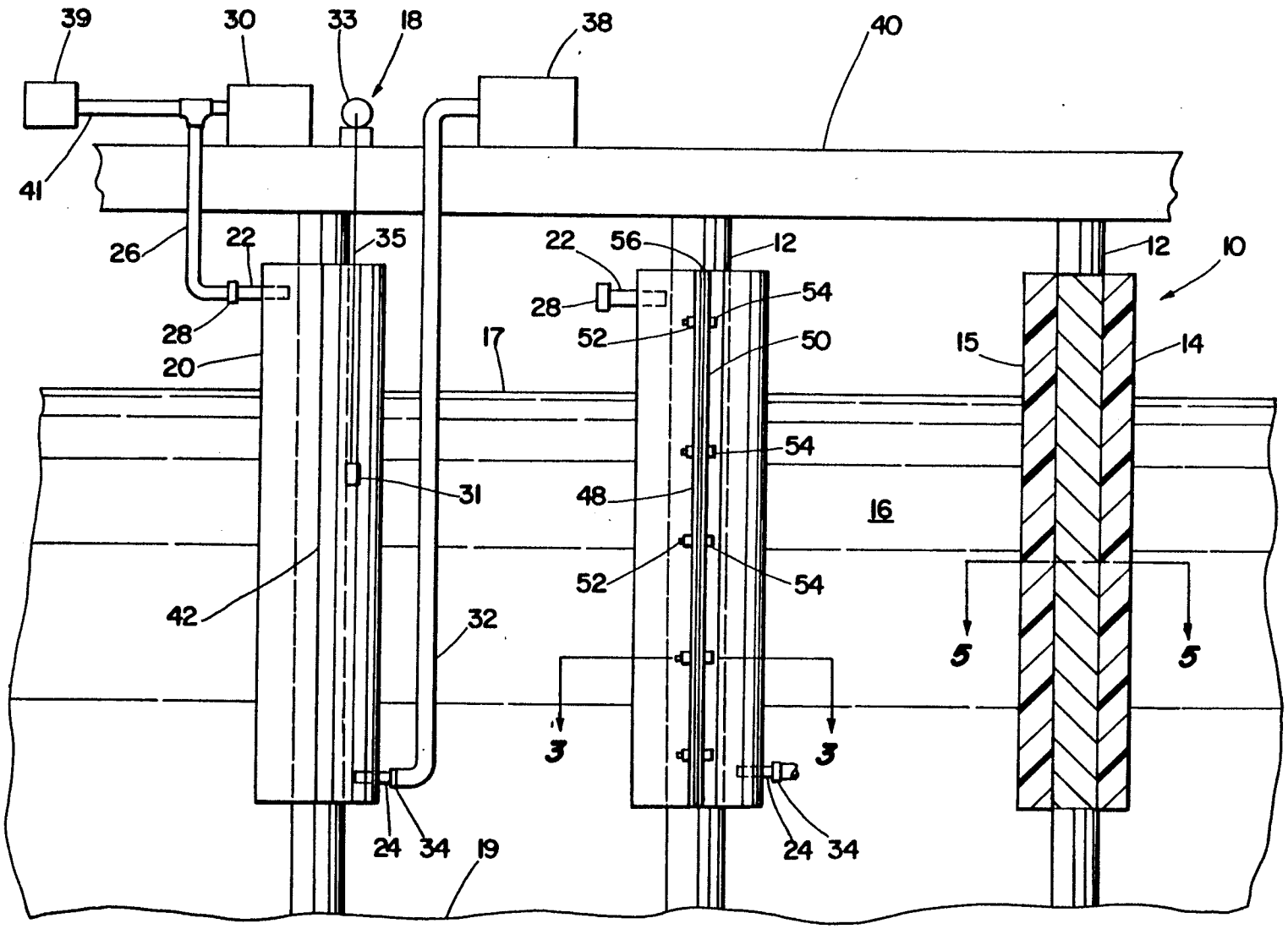
FIG. 1 is a side elevation partially in section illustrating three submerged piles supporting a pier, with each of the three piles in a different stage of treatment according to the present invention, wherein a jacket is installed on a pile prior to coating.

Referring to FIG. 1, there is shown a pile 10 treated according to the present invention, which includes a pile 12 made of wood, steel, or other material, that is coated by a coating 14. The pile 12 is submerged in a body of water 16. The coating 14 is applied along any desired portion of the pile 12, which preferably includes the splash zone 15, that is, the length of the pile that is subject to wave action from weather and tides, and may further include a depth below the normal water line 17 sufficient to encounter a low level of dissolved oxygen in the water about the pile. The water 16 may be fresh water or salt water. The method and apparatus disclosed herein may also conveniently be used to encapsulate and treat areas that are entirely underwater, as discussed below in relation to FIG. 6, 7. Wooden piles will typically be treated from the top of the splash zone 15 to the mud line 19.

The coating 14 may be any desired coating that provides specific benefits in a particular environment. For example, preventing rust may be a goal of treatment of steel piles, especially in salt water environments. Then any of various epoxy compounds may be preferred.

When wooden piles are treated, one goal of treatment may be to prevent wood boring pests from damaging the wood, in which case epoxy, grout, rubber or rubber-like compounds, concrete and the like may be a preferred coating material. Alternatively, the jacket 20 may be filled with an appropriate pesticide, either in a liquid or gaseous state, and the jacket 20 can be sealed by closing the valves 22, 24 for a predetermined time required to assure the eradication of the pests. Then the valves 22, 24 are opened and the residual pesticide is exhausted and treated in the recovery tank 38. Then the desired coating is applied as described below.

If it is desired to prevent impact damage, an expanding closed cell material, rubber or rubber-like material may be a preferred coating.

Still referring to FIG. 1, an apparatus 18 for treating piles 12 includes a jacket 20 secured about the portion of the pile 12 to be treated, an upper valve 22 near the top of the jacket 20 and a lower valve 24 near the bottom of the jacket 20. The valves 22, 24 are installed in the jacket 20 before it is applied to a pile. The upper valve 22 and the lower valve 24 permit or allow fluid flow into and out of the encapsulated space 27 and they may be operated to permit fluid flow from the top of the jacket 20 to the bottom of the jacket 20 or from the bottom of the jacket 20 to the top of the jacket 20.

This capability allows complete management of the fluid flow at any desired rate and any desired direction. The valves 22, 24 are secured and sealed within apertures in the jacket 20 by welding beads 21, caulking, or other suitable means (see, for example, FIGS. 2, 3). The valves 22, 24 are both two way valves that allow fluid flow either into or out of the encapsulated space 27, as selected by the user. The valves 22, 24 can be clamps that pinch the hose closed adjacent to the jacket 20 when desired, or they may be ball valves or the like.

Initially, an air hose 26 is connected to the air inlet valve 22 by a coupling 28 at one end and an air compressor 30 at the other end. The lower valve 24 is connected to a discharge hose 32 via a coupling 34, which is routed back above the surface of the body of water 16 and is connected to a recovery tank 38. The direction of the fluid flows in the draining and drying mode of operation is indicated by the arrows 21 in FIG. 2.

In most applications air or other gas will be injected through more than one upper valve 22 and the gas or other fluid will flow out of the jacket 20 through more than one lower valve 24. The number of such valves and their distribution along and about the jacket 20 for a particular application depends on factors such as the length of the portion of the pile that will be treated, the volume of water that must be expelled from the jacket 20, the temperature of the surrounding water, the viscosity and flow characteristics of the coatings o other chemicals to be applied to the pile and so forth. In some applications there may be a large number of such valves, but for simplicity only one of each is shown in the drawing figures. Appropriate baffles may be installed inside the jacket 20 to control the air flow through the jacket 20 as desired, causing the air, for example, to swirl about the pile 12.

During treatment of a pile 12, the water in the encapsulated space 27 between the jacket 20 and the pile 12 is forced out through the lower valve 24 by compressed gas, preferably air, that is introduced through the upper valve 22. Alternatively, the air or other gas can be forced air, as from a squirrel cage blower or other source of forced air connected to suitable ducts. This means of forced air flow can also be used during the drying procedure described below. The discharged water may be returned to the body of water 16 either by disconnecting the discharge hose 32 from the recovery tank 38 or draining the water in the recovery tank 32 itself back into the body of water 12.

The air compressor 30, recovery tank 38 and other equipment and supplies may be conveniently set up on a pier 40, which rests on the piles 12, as shown in FIG. 1. Alternatively, this equipment may be set up on boats, barges, and the like that operate adjacent to the piles to be treated, or on a platform suspended from a pier. This later technique can be useful when the pier or other platform itself is located far above the surface of the water.

The jacket 20 includes at least one longitudinal axis or edge. When the longitudinal edges of the jacket 20 are brought together, a seam 42 is formed, which allows the jacket 20 to be installed on a submerged pile that has a platform, pier or other structure on top of it. In the preferred embodiment, there are two longitudinal axis or seams 42 located opposite each other across a diameter of the cylindrical jacket 20.

Figure 3:
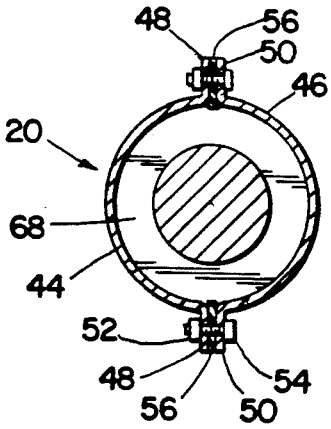
FIG. 3 is a cross section of a pile prepared for treatment according to one embodiment of the present invention taken along lines 3—3 of FIG. 1.
Figure 2:
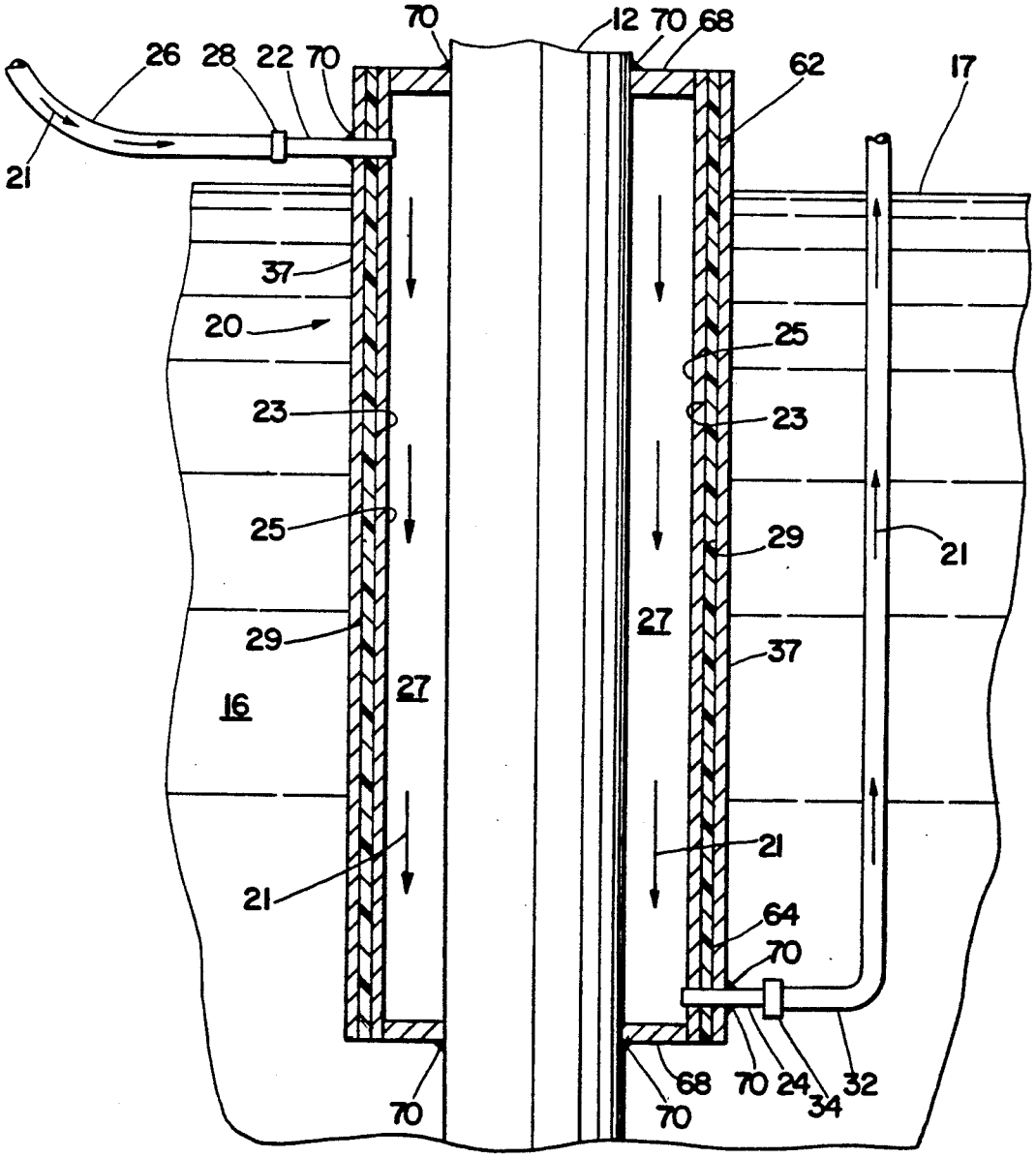
FIG. 2 is a side elevation partially in section illustrating one embodiment of the present invention.

Referring to the middle jacket 20 in FIG. 1, and FIGS. 2, 3, in the preferred embodiment, the jacket 20 comprises two metal tube portions, each having a substantially semi-circular or other arcuate cross section with fastening flanges at each lengthwise edge. A jacket of more than two sections may be more convenient to use with especially large diameter piles. In this case, arcuate sections are still preferred, as they provide greater strength than flat sections, for example, eight sections forming an octagonal cross section.

Referring to FIG. 3, the jacket 20 includes two symmetrical tube portions 44, 46, with flanges 48, 50 respectively that run continuously along the length of each tube portion 44, 46. These two tube portions are fastened by a plurality of fasteners, such as nuts and bolts 52, 54 (See also FIG. 1) inserted through corresponding apertures. A rubber gasket 56 is disposed between the flanges 48, 50 before they are fastened together to provide a tight seal between the members.

Figure 4:
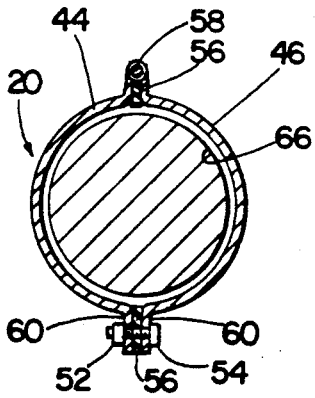
FIG. 4 is a cross section a pile prepared for treatment according to another embodiment of the present invention, which is analogous to FIG. 3, but illustrates a different embodiment of the present invention, which utilizes a different style of jacket.
Figure 5:
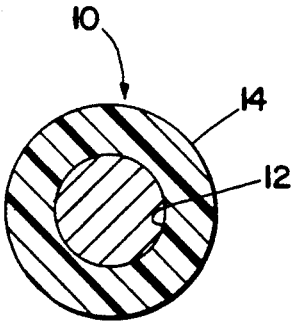
FIG. 5 is a cross section of a pile after treatment according to the present invention taken along lines 5—5 of FIG. 1.

In the alternative embodiment of the jacket 20 illustrated in FIG. 4, the jacket 20 is a one-piece jacket 20 having a piano hinge 58 running the length of the jacket 20 along a longitudinal axis of the jacket 20 for pivotally connecting the two sections of the jacket 20. Matching flanges 60 attached to the edges of the jacket 20 opposite to the hinge 58. A gasket 56 is disposed in between the piano hinge members. A gasket 56 is disposed between the flanges 60 prior to fastening the flanges 60 together with a plurality of nuts and bolts 52, 54 distributed along the length of the jacket 20. The gasket 56 along an type of longitudinal seam 42 may be permanently attached to one flange or hinge portion so that the gasket is a permanent part of the jacket 20 and it is not necessary to fit the gasket into place underwater. In either embodiment, the jacket 20 is preferably made of sheet metal core 29 of sufficient strength to withstand the pressures developed in a particular application.

Referring to FIG. 2, the interior surface 23 of the jacket 20 is coated with a permanent coating of a slippery substance 25, such as Teflon (Registered Trademark) low friction coating or Silverstone (Registered Trademark) low friction coating to reduce or prevent adhesion of a coating that is applied to the pile.

A coating or layer of heat insulation 37 covers the exterior of the jacket 20. The jacket 20 is removed from the pile 12 after whatever coating 14 that is applied has cured, making the jacket 20 reusable. In some applications it can be expected that the coating will be forced into the encapsulated space under pressures of about 50 pounds per square inch ($3.44\times10^6$ dynes/cm$^2$). A typical application of this type is the application of epoxy resins to wooden piles which have deteriorated or been consumed so that a significant portion of the pile has been destroyed or the surface is severely pocked. In such a case, high pressure forces the epoxy into all the cavities in the pile. The surface of the pile is thus built up to fill voids and to increase the structural integrity and strength of the pile 12.

The jacket 20 forms a cylinder about the pile 12. To provide a sealed and controlled environment about the portion of the pile 12 to be protected it is necessary to seal the top end 62 and the bottom end of the jacket 64. How this is done depends on the type of coating that is desired.

If a relatively thin coating (e.g., about ¼ inch; 0.635 cm) is to be used, for example an epoxy coating, a gasket 66, shown in FIG. 4, is installed at the top end 62 and a second gasket 66 is installed at the bottom end 64 of the jacket 20 (See FIG. 2) before the flanges 50 are fastened together. The gasket 64 is made of suitable material such as rubber or a synthetic rubber that will not be significantly degraded during the curing period of the coating. The gaskets 64, which may be similar to O-rings, are suitable dimension so that they are clamped tightly between the jacket 20 and the pile 12 when the flanges 48, 50, or 60 are fastened together. The gaskets 64 are preferably split into two pieces with overlapping ends, allowing them to be permanently attached to the edges of the jacket 20 by adhesives. This construction eliminates the need to assemble the gaskets and the jacket 20 underwater.

In an alternative embodiment illustrated in FIG. 2, a thicker coating, such as closed cell foam, silicon based caulking-type material, synthetic rubber, and the like, is used to fill the encapsulated space. A thicker, more shock absorbing coating is desirable when it is important to protect the pile 12 from impact.

In this case, the encapsulated space 27 between the pile 12 and the jacket 20 is larger and the space between the two elements cannot be sealed by a simple gasket. In such a case a pair of end caps 68 seal the top end 62 and bottom end 64 of the jacket 20. The end caps may be made in sections and are sealed by a suitable sealing compound 70.

Still referring to FIG. 2, the end caps 68 are seated within the ends of the jacket 20, and are drawn into sealing engagement with the jacket 20 when the longitudinal flanges are fastened together. Alternatively, the end caps 68 can overlap and extend beyond the outer edges of the jacket 20.

The process for using the equipment described above is as follows. The pile surface may be prepared according to well known techniques, for example, sandblasting, wire brushing, and so forth, prior to installation of the jacket 20.

After surface preparation, the jacket 20 is installed by divers, who maneuver the jacket 20 into position, bring the flanges 48, 50 (FIG. 3) or 60 (FIG. 4), as the case may be, together and fasten the flanges 48, 50 together. In the case of a thin coating application, the top end 62 and bottom end 64 of the jacket 20 are automatically sealed by the gaskets 66.

In the case of applying a thicker coating using the jacket 20 assembly shown in FIG. 2, the end caps 68 are preferably installed after surface preparation of the pile 12 but before the jacket 20 is installed, although the jacket 20 can be installed first if desired. In this case, it is advantageous to supply a device for holding the jacket 20 at a desired vertical location.

After the jacket 20 is attached to the pile 12, the air inlet hose 26 is connected to the upper valve 22 and the discharge hose 32 is connected to the lower valve 24, or to all upper hoses and all lower hoses when multiple upper and lower hoses are used. The other end of the air hose 26 is then connected to the air compressor 30 (FIG. 1). The air compressor 38 is turned on and the water is pushed downward and out of the encapsulated space 27 between the jacket 20 and the pile 12 and is returned to the body of water 16 through the discharge hose 32. Then the encapsulated space 27 is dried by continuing to force air through it. Drying agents, such as alcohol or other chemicals, may be introduced into the air stream, as described below.

Figure 6:
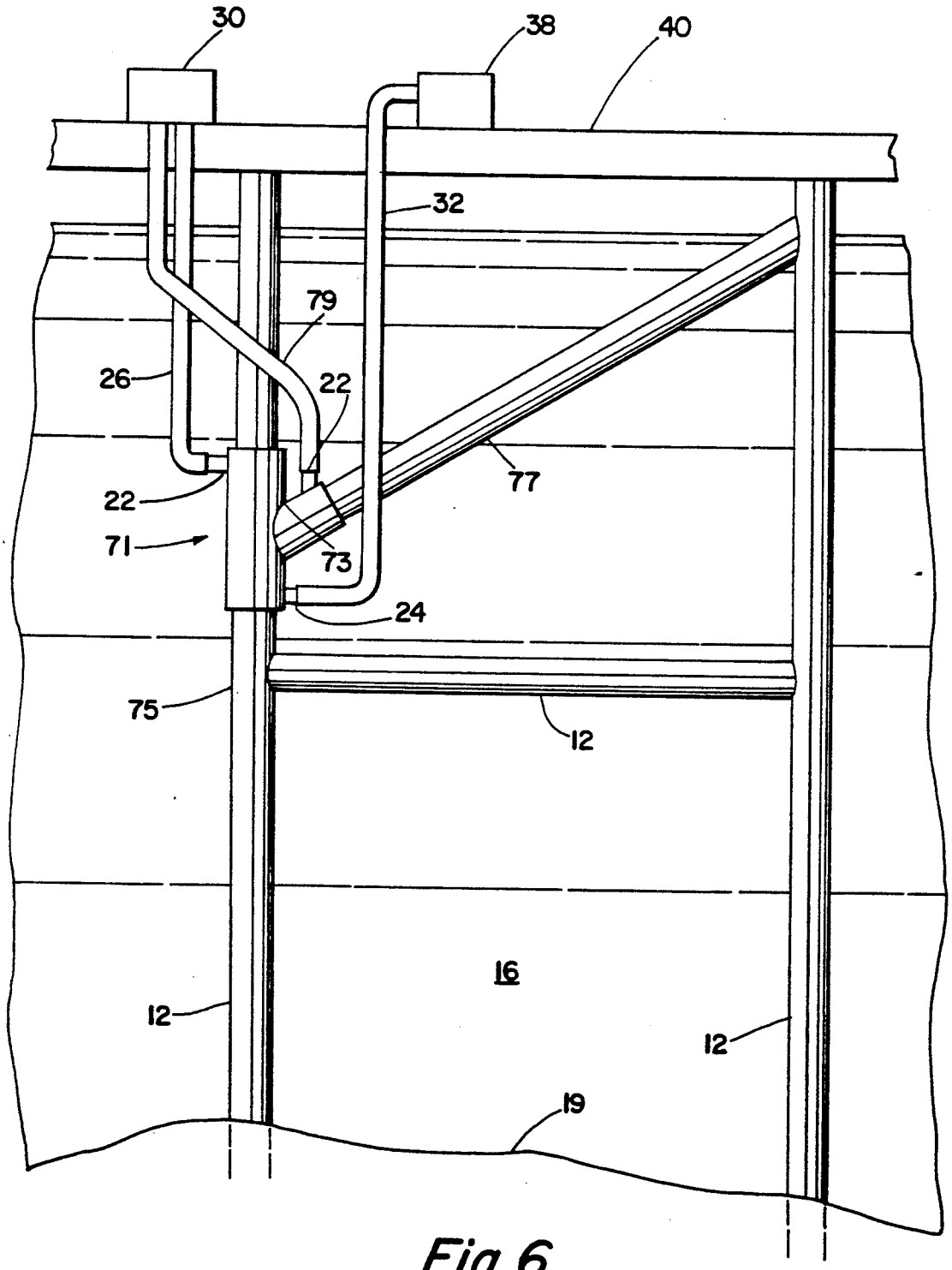
FIG. 6 is a side elevation of the present invention in use on a pile marine structure illustrating use of the invention on completely submerged members and use of the invention on a joint between two submerged members.

Referring now to FIG. 6, there is shown another embodiment of the jacket 71, which is used to encapsulate a joint 73 and adjacent piles formed by at the conjunction of the pile members 75, 77. All portions of the treatment areas of the piles 75, 77, and naturally all of the jacket 71 are underwater. The means for emptying, drying and treating the encapsulated space are the same as those described for the other embodiments described herein. At least a second air hose 79 and upper valve 81 are included near the Y-junction of the pile members 75, 77 to facilitate emptying and drying.

As clearly shown by FIG. 6, 7, the apparatus and methods disclosed herein can be employed when the entire area to be encapsulated and treated lies wholly underwater. Further, the encapsulation, drying and treatment techniques disclosed herein can be employed regardless of the spatial orientation of the members to be encapsulated and treated in space or relative to one another, whether they are, for example, horizontal, vertical, or at any other orientation to any given reference point. A jacket can be designed according to the techniques disclosed herein for any type of joint or structure.

When the encapsulated space is dry, a positive flow of air or other gas is maintained through the encapsulated space 27, providing a dry, stable, controlled environment within the encapsulated space 27. Within this controlled environment, further treatment of the pile 12 can be made as desired with assurance that the treatments will be effective. Superior adhesion and curing of any chemical treatments, coatings and the like result from having a dry, controlled environment.

Low temperatures can severely reduce the efficiency of chemical reactions that cure many coatings, such as two-part epoxies, two part foaming mixtures and so forth. Many coatings will not cure properly at low temperatures, but coating work often must be done at low temperatures. In these situations, the air forced into the encapsulated space is preheated by a heater 39 (FIG. 1) and the temperature inside the encapsulated space is monitored by a temperature sensor 31, which is connected to a readout device 33 by an electrical cable 35. The heater 39 is connected to the air hose 26 by the heater hose 41 when the apparatus is in the draining and drying mode. The temperature sensor 31 may be directly attached to or embedded in the pile 12 to monitor the actual temperature of the pile 12, which is increased to a desired level, for example, 30 degrees C., to accelerate the curing process of chemical treatments.

The layer of heat insulating coating 37 (See FIG. 2) on the outside of the jacket 20 helps retain the heat thus transferred to the encapsulated space 27 and the pile 12, further facilitating curing. Applying a coating on both the outside and inside surfaces of the jacket 20, such as the slippery coating 25 on the inside surface of the jacket 20 and the heat insulation 37 on the outside surface of the jacket 20, also reduces corrosion of the jacket 20 itself, thereby significantly extending its life. Multi-part chemically reactive coating mixtures normally produce exothermic reactions. When they are injected into a warm insulated environment the temperature necessary for proper curing can ordinarily be maintained even in relatively cold water. The air used for drying the encapsulated space can beneficially be heated to provide dry air for drying the encapsulated space even when heating the pile is not necessary to assist the chemical reactions of the coating. Heating the forced air to speed drying may be especially helpful when relative humidity is high. Further enhanced drying is achieved by using chemical drying agents, such as alcohol and the like.

When the portion of the pile 12 to be protected has been encapsulated, water expelled, dried, and the temperature has been controlled, chemical treatment of the pile can begin. As noted above, in the case of steel piles, it is often desirable to inject a rust inhibitor, or a coating that chemically combines with surface rust, destroying the rust, and simultaneously seals the surface against further rust. When that coating has cured, a second coating, such as a two-part close cell foam material, a multi-part epoxy resin coating, silicon based compound, synthetic rubber, or the like may be applied. Pigments of various colors may be mixed with the epoxy resins or other coatings to provide coated piles having any desired color, which can be used for safety or ornamental purposes and provides a pleasant alternative to the normally drab blacks and browns of most piles.

Alternatively, a rust inhibitor or a coating that combines with rust to seal the surface and prevent further oxidation can be combined with the desired filler coating material, for example, epoxy and the mixture can then be used to fill the encapsulated space 27. Any coating, treatment chemicals, foam, grout, concrete, epoxy, sand, gravel, or other material to be applied to the pile 12 inside the encapsulated space 27 is defined as "filler," whether or not any chemical reaction occurs between elements of the filler or between the filler and the pile.

Figure 7:
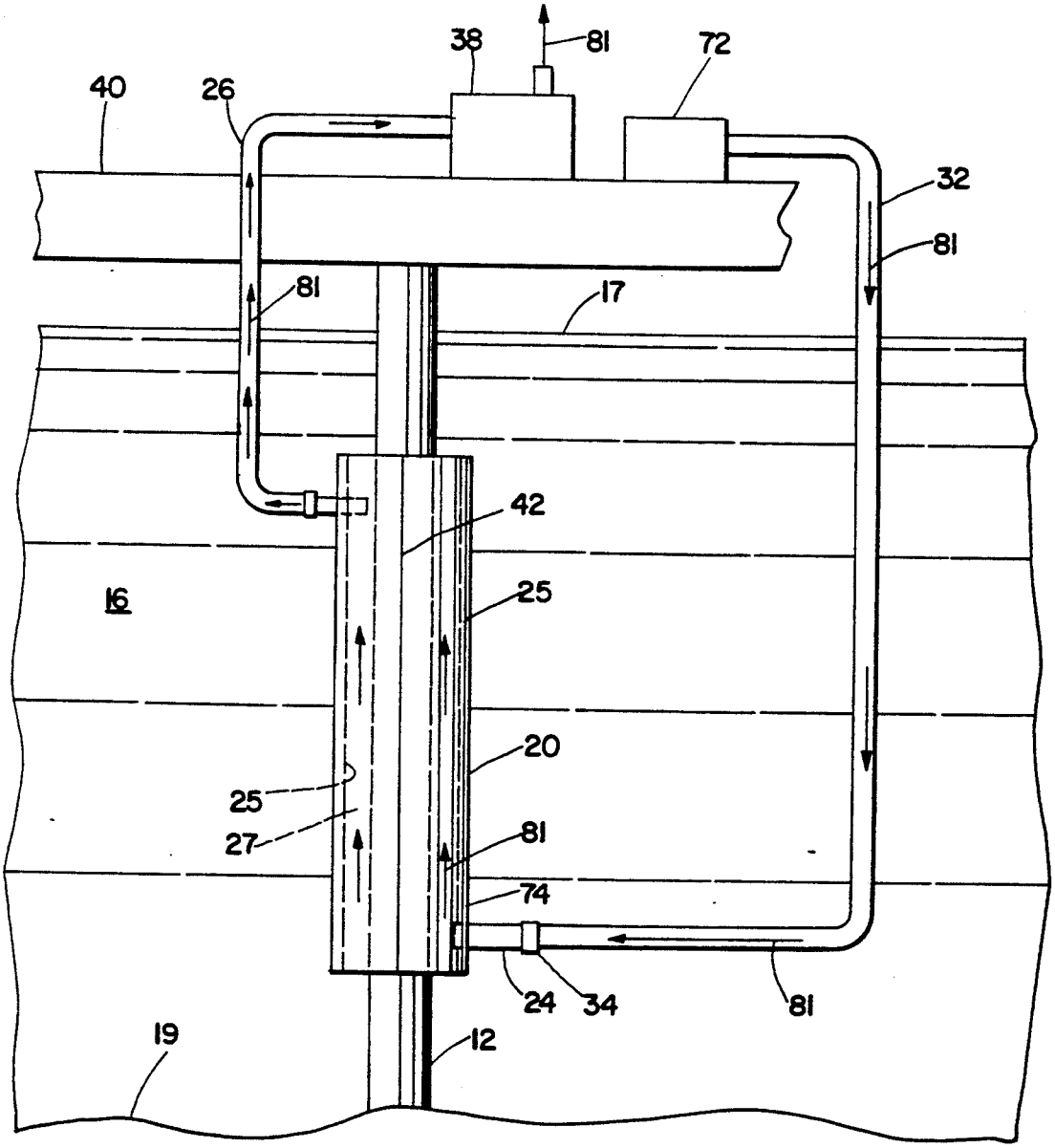
FIG. 7 is a side elevation partially in section illustrating the present invention in a preferred coating application mode.

In the preferred embodiment illustrated in FIG. 7, the coating material enters from the lower portion of the jacket 20 and vapors are vented from the upper portion of the jacket 20. Many types of coatings, for example, expanding foam materials, flow better when introduced from the lower portion of the jacket 20. Therefore, the hose connections, valves and fluid flows are reversed relative to the set up used for draining and drying the encapsulated space.

Still referring to FIG. 7, a coating pump 72 is connected to the hose 32, which becomes a coating hose instead of a discharge hose. The coating pump 72 has suitable characteristics for application of a specific coating. The hose 26 is then connected to the recovery tank 38. The direction of the fluid flows is indicated by the arrows 81. The air compressor 30, and other ancillary equipment (not shown in FIG. 7) used for draining and drying the encapsulated space 27 enclosed within the jacket 20 (shown in FIG. 1) are disconnected and not used for the treatment and coating processes described in relation to FIG. 7.

The whole of the encapsulated space 27 is filled with whatever coating will be used. Any vapors, that is, air and entrained matter, rising from the encapsulated space when the coating material is injected are recovered by the hose 26, which conveys excess vapors, products of reaction and so forth from the controlled environment of the encapsulated space 27 to the recovery tank 38, which is equipped with suitable filters, condensers, and the like to prevent the release of significant amounts of toxic chemicals and other pollutants into the atmosphere or the water. the entrained matter may include vapors, solids, fluids, and so forth.

In the case of a wooden pile 12, the process is the same, but the treatment chemicals may be different. It may be desired, for example, to first treat the encapsulated space with a pesticide that will kill all the marine creatures within the encapsulated space. The controlled environment created in the encapsulated space is especially beneficial in this case because the pesticide can be allowed to remain in the encapsulated space long enough to insure that all the marine creatures are killed. This can be accomplished either by continuing to apply pesticide, or by applying a measured dose of pesticide, then sealing the air hose 26 and the discharge hose 32 at convenient points and allowing the pesticide to remain in the encapsulated space for a predetermined time. The use of the recovery tank 38 to recover such vapors can be especially beneficial to the environment in this case. Following pesticide treatment, other desired coatings may be applied as discussed above.

Figure 8:
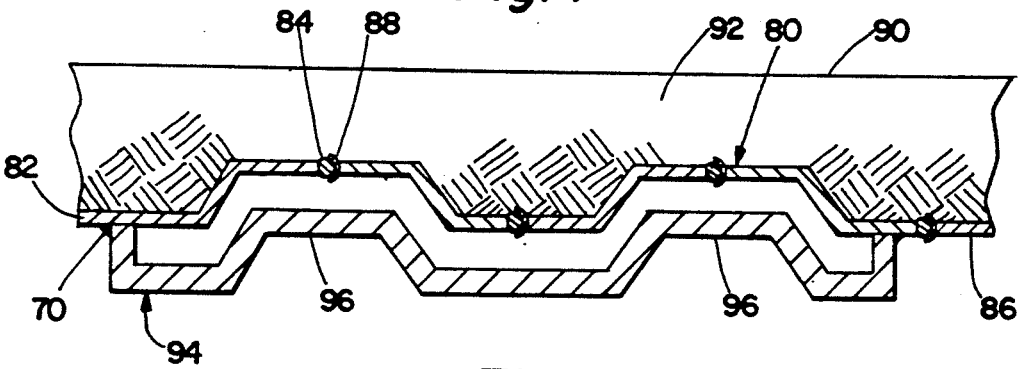
FIG. 8 is a fragmentary cross section along a substantially horizontal line of the present invention in use with a substantially vertical sheet pile marine structure.

Referring to FIG. 8, there is shown a fragmentary cross section taken along a substantially horizontal line through a substantially vertical sheet pile 80 comprising a plurality of corrugated interlocking sections, of which sections 82 include a male joint 84 and sections 86 include a female joint 88. Each section 82, 86 is typically about two feet long. The sheet pile 80 is typically driven into the mud near the shore line 90 and the space between the sheet pile 80 and the shore line is back-filled with filler material 92, such as concrete, gravel, earth, and so forth. A pier or other structure can be built on top of the sheet pile 80 and filler 92. A jacket 94 of sheet metal or the like is designed to be installed roughly parallel to the sheet pile 80 and preferably includes corrugations 96 substantially matching those of the sheet pile 80 to provide greater strength in the jacket 94. The jacket 94 is installed and sealed as described above. The equipment and processes for treating the sheet pile 80 are as described above. It is to be understood that while certain forms of the invention have been illustrated and described herein, the invention is not limited thereto, except insofar as the limitations are included in the following claims.

I claim:

1. A process for creating a controlled environment about at least a portion of a submerged pile comprising the steps of:

a. securing a jacket having at least one longitudinal seam along a portion of a pile to be treated and sealing said jacket to encapsulate a space along a desired length of said pile;

b. providing at least one upper valve and at least one lower valve for allowing fluid flows into and out of said encapsulated space;

c. expelling water trapped in said encapsulated space through said lower valve by injecting a gas into said encapsulated space through said upper valve;

d. drying the encapsulated portion of said pile by further injecting a preheated gas into said upper valve and maintaining a flow of said preheated gas through said encapsulated space until said encapsulated portion of said pile is dry; and e. filling said encapsulated space with a filler material thereby forestalling further deterioration of said encapsulated portion of said pile.

2. A process in accordance with claim 1 further comprising the additional step of flushing said encapsulated space with fresh water following step c to purge contaminants from said encapsulated space prior to further treatment.

3. A process in accordance with claim 2 further comprising the additional steps of treating said encapsulated space with chemicals to stabilize existing corrosion and to kill marine pests.

4. A process in accordance with claim 1 wherein said step of filling said encapsulated space further comprises filling said encapsulated space with a closed cell foam material.

5. A process for creating a controlled environment about at least a portion of a submerged pile comprising the steps of:

a. securing a jacket having at least one longitudinal seam along a portion of a pile to be treated and sealing said longitudinal seam to encapsulate a space along a desired length of said pile;

b. providing at least one upper valve and at least one lower valve for allowing fluid flows into and out of said encapsulated space;

c. expelling water trapped in said encapsulated space through said lower valve by injecting a gas into said encapsulated space through said upper valve;

d. filling said encapsulated spaced with a filler material to forestall further deterioration of said encapsulated portion of said pile; and e. recovering waste products and vapors from said filler material by collecting them and conveying them to a holding tank.

6. A process in accordance with claim 5 further comprising the additional step f of removing said jacket from said pile.

7. A process for treating at least a portion of a submerged pile comprising the steps of:

a. securing a jacket having at least one longitudinal seam along a portion of a pile to be treated and sealing said longitudinal seam to encapsulate a space along a desired length of said pile;

b. providing at least one upper valve and at least one lower valve for allowing fluid flows into and out of said encapsulated space;

c. sealing the top and bottom of said jacket relative to said pile;

d. expelling water trapped in said encapsulated space through said lower valve by injecting a gas into said encapsulated space through said upper valve; and e. drying said encapsulated portion of said pile by further introducing a gas into said upper valve and maintaining a flow of gas through said encapsulated space out of said lower valve until said encapsulated portion of said pile is dry and filling said encapsulated space with a filler, which displaces the air inside said encapsulated space; and f. recovering and treating said gas and entrained matter that are displaced from said encapsulated space by said filler by collecting it at said upper valve and conveying it to a recovery tank.

8. An apparatus for treating a submerged pile comprising a jacket having at least two longitudinal sections of arcuate cross section with a sealing means along each said longitudinal edge of each said arcuate section for fastening said sealing means from different said longitudinal sections together along a plurality of seams formed by so joining said longitudinal edges, a hinge means joining at least two said longitudinal sections, at least on upper valve and one lower valve, and a low friction coating one the interior surface of said jacket, with said jacket having a perimeter larger than said submerged pile for creating an encapsulated space about said submerged pile.

9. An apparatus for treating a submerged pile comprising:

a. a jacket having at least two longitudinal sections of arcuate cross section with a flange along each longitudinal edge of each said arcuate section, a plurality of apertures in each said flange, means for fastening said flanges from different said longitudinal sections together along a plurality of seams formed by so joining said flanges;

b. a low friction coating on the interior surface of said jacket;

c. a heat insulation layer on the exterior surface of said jacket;

d. hinge means joining at least two said longitudinal sections; and e. at least one upper valve and at least one lower valve.

10. An apparatus for creating a controlled environment about at least a portion of a submerged pile comprising:

a. a jacket for encapsulating a desired portion of said pile, said jacket further comprising at least one upper valve and at least one lower valve, at least two longitudinal sections of arcuate cross section with a flange along each longitudinal edge of each said arcuate section, a plurality of apertures in each said flange, means for fastening said flanges from different said longitudinal sections together along at least one seam formed by so joining said flanges;

b. a low friction coating on the interior surface of said jacket;

c. a heat insulation layer on the exterior surface of said jacket;

d. hinge means joining at least two said longitudinal sections;

e. at least one upper valve and at least one lower valve;

f. means for controlling the direction of fluid flow through said valves and thereby through said encapsulated space, thereby expelling water inside said encapsulated space and drying said space; and g. means for introducing a filler into said encapsulated space.

11. An apparatus for creating a controlled environment about at least a portion of a submerged pile comprising:

a. a jacket for encapsulating a desired portion of said pile, said jacket further comprising at least one upper valve and at least one lower valve;

b. means for controlling the direction of fluid flow through said valves and thereby through said encapsulated space;

c. means for forcing a gas into said encapsulated space, thereby expelling water inside said encapsulated space and drying it;

d. means for introducing a filler into said encapsulated space; and means for recovering and treating gas and entrained matter that are displaced from said encapsulated space.

12. An apparatus in accordance with claim 11 wherein said jacket further comprises a plurality of sections each having a longitudinal axis and means for pivotally connecting said plurality of sections along said longitudinal axes.

13. A process for treating an underwater pile comprising the sequential steps of:

a. encapsulating a portion of a pile to be treated to form an encapsulated space about said treatment portion of said pile;

b. removing standing water from said encapsulated portion of said pile;

c. preparing an exterior pile surface of said encapsulated portion of said pile by circulating surface preparing chemicals through said encapsulated portion of said pile, whereby said exterior surface of said encapsulated portion of said pile will bond with a chemical coating; and d. injecting a coating material into said encapsulated portion of said pile.

14. A process in accordance with claim 13 further characterized by selecting said treatment portion of said pile in a splash zone along the length of said pile.

15. A process in accordance with claim 13 wherein step b further comprises injecting compressed air into said encapsulated portion through a controlled opening at an upper end of said encapsulated portion of said pile and thereby forcing the standing water out from a controlled opening at a lower end of said encapsulated space.

16. A process in accordance with claim 13 wherein step d further comprises injecting said coating material into said encapsulated portion of said pile through a controlled opening at a lower end of said encapsulated portion and releasing the air so displaced from a controlled opening at an upper end of said encapsulated portion.

17. A process in accordance with claim 16 further comprising mixing a coating compound having at least two constituent materials that chemically combine and bond to said encapsulated portion of said pile prior to injecting said coating into said encapsulated space in step d.

18. A process in accordance with claim 13 further comprising the additional step of circulating air through said encapsulated space to dry said space between steps c and d.

19. A process in accordance with claim 18 further comprising heating said air prior to circulating said air through said encapsulated portion, whereby said drying is accelerated.

20. A process in accordance with claim 19 further comprising the additional step of maintaining the circulation of said heated air in said encapsulated portion until said encapsulated portion reaches a temperature conducive to proper curing of a chemically reactive coating to be applied in step d.

21. A process in accordance with claim 13 wherein said surface preparation of step b further comprises removing rust and other corrosion from an exterior surface of a metal pile.

22. A process in accordance with claim 13 wherein the surface preparation of step b further comprises removing material from an exterior surface of a pile.

23. A process in accordance with claim 13 wherein step c further comprises inhibiting rusting of a metal pile, thereby arresting further corrosion of said pile.

* * * * *